US012285666B2

(12) United States Patent
Xu et al.

(10) Patent No.: US 12,285,666 B2
(45) Date of Patent: Apr. 29, 2025

(54) GOLF TEE NEST

(71) Applicants: Jian Xu, Xian (CN); Feier Xu, Xian (CN)

(72) Inventors: Jian Xu, Xian (CN); Feier Xu, Xian (CN)

( * ) Notice: Subject to any disclaimer, the term of this patent is extended or adjusted under 35 U.S.C. 154(b) by 0 days.

(21) Appl. No.: 18/464,105

(22) Filed: Sep. 8, 2023

(65) Prior Publication Data

US 2025/0083005 A1 Mar. 13, 2025

(51) Int. Cl.
*A63B 57/10* (2015.01)

(52) U.S. Cl.
CPC ..... *A63B 57/10* (2015.10)

(58) Field of Classification Search
CPC ..... A63B 57/10; A63B 57/00; A63F 9/06
USPC ..... 273/156
See application file for complete search history.

(56) References Cited

U.S. PATENT DOCUMENTS

| | | | | | |
|---|---|---|---|---|---|
| 478,377 | A | | 7/1892 | Smith | |
| 2,079,387 | A | | 5/1937 | Sickmiller | |
| 3,612,537 | A | * | 10/1971 | Sato | A63F 9/1252 273/156 |
| 3,695,617 | A | * | 10/1972 | Mogilner | A63F 9/0876 446/116 |
| 4,162,071 | A | | 7/1979 | Fish | |
| 4,625,968 | A | * | 12/1986 | McDermott | A63F 9/08 273/156 |
| 4,811,948 | A | * | 3/1989 | Gutierrez | A63F 9/12 273/156 |
| D368,503 | S | * | 4/1996 | Bess | D21/717 |
| 6,460,850 | B1 | * | 10/2002 | Dodek, II | A63F 9/12 273/156 |
| 7,448,967 | B1 | * | 11/2008 | Panneri | A63B 57/10 473/390 |
| 9,302,163 | B1 | | 4/2016 | Maldonado | |
| 9,808,687 | B1 | * | 11/2017 | Kalcich | A63B 57/13 |
| D865,078 | S | * | 10/2019 | Peng | D21/499 |
| D921,127 | S | * | 6/2021 | Kendall | D21/499 |
| D1,020,943 | S | * | 4/2024 | Xu | D21/717 |
| 2007/0262522 | A1 | | 11/2007 | Lu | |
| 2008/0064517 | A1 | * | 3/2008 | Stuart | A63B 57/10 473/132 |

FOREIGN PATENT DOCUMENTS

| | | | | |
|---|---|---|---|---|
| CN | 215427247 U | * | 1/2022 | |
| GB | 2548843 A | * | 10/2017 | A63B 57/10 |

* cited by examiner

*Primary Examiner* — Steven B Wong

(57) ABSTRACT

A golf tee nest is a device designed to help golf enthusiasts practice different golf skills as well as to serve as a storage box or a gift box for one or more golf balls. The device includes a plurality of interlocking pieces and a plurality of golf tees. The plurality of interlocking pieces corresponds to several triangular-shaped retaining pieces that can hold a golf ball in different ways for different golf-related activities. The plurality of interlocking pieces is also designed to be rearranged into different configurations to facilitate the different golf-related activities that the user can perform with the device. The plurality of golf tees corresponds to several golf tees specially designed to facilitate the coupling of the plurality of interlocking pieces in different configurations. The plurality of golf tees can also be utilized without the plurality of interlocking pieces to perform different golf-related activities.

20 Claims, 23 Drawing Sheets

GOLF TEE NEST

FIELD OF THE INVENTION

The present invention relates generally to exercise and sport equipment. More specifically, the present invention provides a novel multi-purpose device that can be used for putting practice or as a gift box for golf balls.

BACKGROUND OF THE INVENTION

There is a lack of diversity in exercise equipment that is currently on the market. Most exercise equipment serves a single purpose, which increases the amount of equipment the user must purchase for a desired sport. For example, golf enthusiasts often purchase training devices to help them improve certain skills such as putting. Different putting training devices have been made available to help users train their putting skills. However, these training devices are limited in their functionality in that they cannot be used for other purposes in an effective manner. For example, if the user wanted to utilize the putting training device as a normal tee, the user would not be able to use the device properly. Thus, there is a need for a more useful golf training device that can be utilized for different training drills and for other purposes related to golf.

An objective of the present invention is to provide a golf tee nest that is designed to be utilized for different golf-related activities, such as putting practice, striking practice, etc. The present invention is innovative, colorful, interesting, and multi-purpose, with a certain degree of technical advancement. The present invention can be used for both recreational and teaching purposes and is suitable for golfers of different levels. Another objective of the present invention is to provide a golf tee nest that is modular and can be reconfigured to be used for the different exercises. The present invention includes a modular structure with several interlocking pieces that can be rearranged to meet the user's needs. Another objective of the present invention is to provide a golf tee nest that can be used as a gift box. The present invention can be rearranged to retain one or more golf balls. The present invention can also include various ornamental designs to be effectively used as a gift box. Additional features and benefits of the present invention are further discussed in the sections below.

SUMMARY OF THE INVENTION

The present invention is a golf tee nest designed as a modular structure that can be rearranged for different golf-related purposes including, but not limited to, putting practice, striking practice, etc. The present invention can also be rearranged to be used as a gift box that can retain at least one golf ball to gift it to someone else. To do so, the present invention includes several interlocking pieces that can be rearranged into different configurations according to the user's needs. Further, the present invention includes several golf tees specially designed to be used as normal golf tees. The golf tees of the present invention can also be used as the fastening means to couple the interlocking pieces together. Thus, the interlocking pieces and the golf tees enable the user to rearrange the present invention into different configurations for different purposes according to the user's needs.

In the preferred embodiment, the several interlocking pieces of the present invention can be arranged to hold at least one golf ball. When two interlocking pieces are coupled together using a golf tee, the inner surfaces of the interlocking pieces form a semi hemisphere. When four interlocking pieces are coupled together using four golf tees, the inner surfaces of the interlocking pieces form a hemisphere. When eight interlocking pieces are coupled together using eight golf tees, the inner surfaces of the interlocking pieces form a sphere. In all these configurations, the interlocking pieces can hold a golf ball in various positions. Two or more cubes constructed using the interlocking pieces can be used for controlled putting practice. Further, a cube formed with eight interlocking pieces can be used to retain a golf ball and be used as a gift box.

Several cubes formed with the interlocking pieces can be coupled together using magnets to hold more golf balls. Furthermore, the several golf tees can be individually used as normal golf tees by the user. In addition, a single interlocking piece of the present invention can also be used as a golf tee.

DETAIL DESCRIPTIONS OF THE INVENTION

All illustrations of the drawings are for the purpose of describing selected versions of the present invention and are not intended to limit the scope of the present invention.

Figure 12:
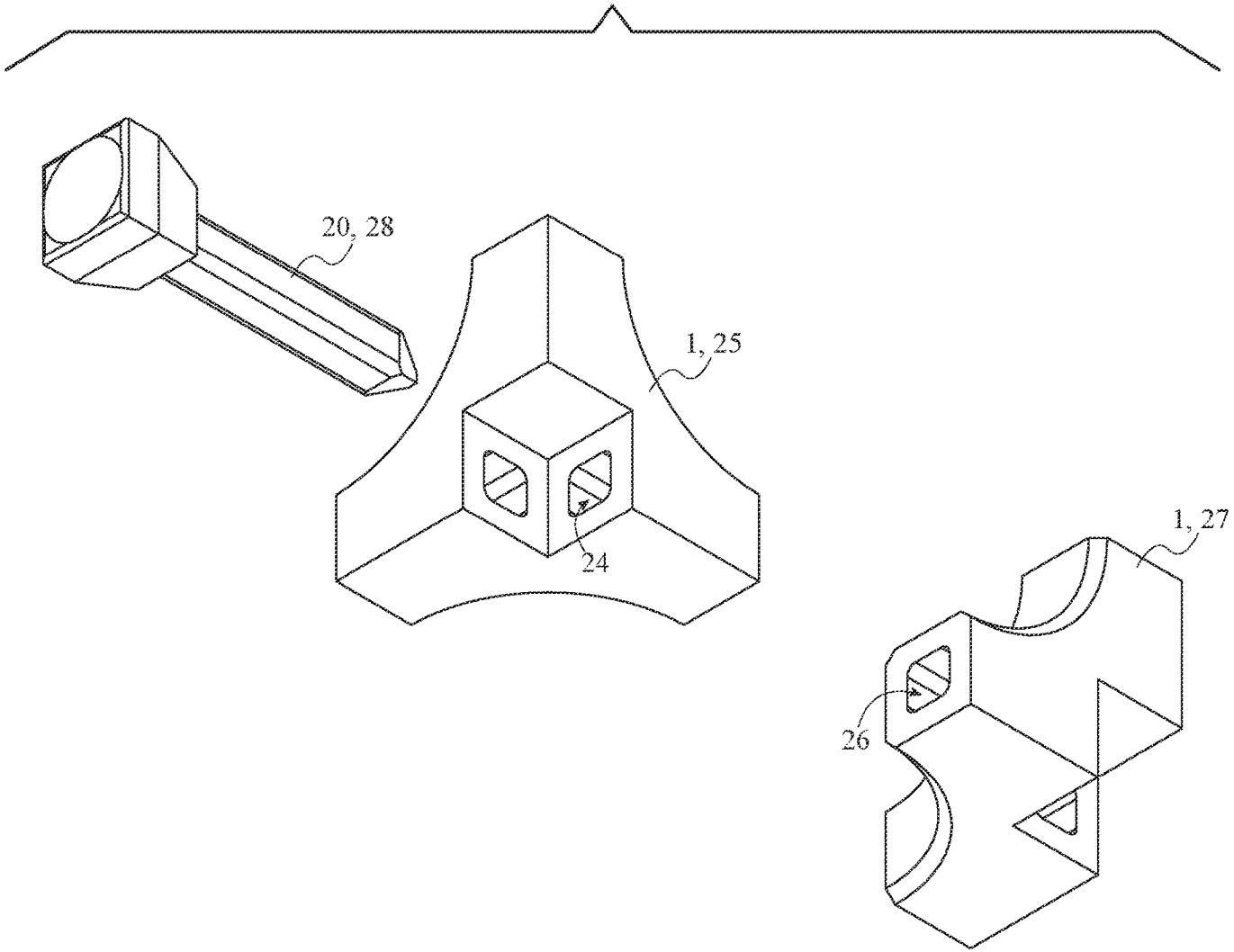
FIG. 12 is a bottom exploded perspective view of two interlocking pieces of the present invention connected by a golf tee.
Figure 13:
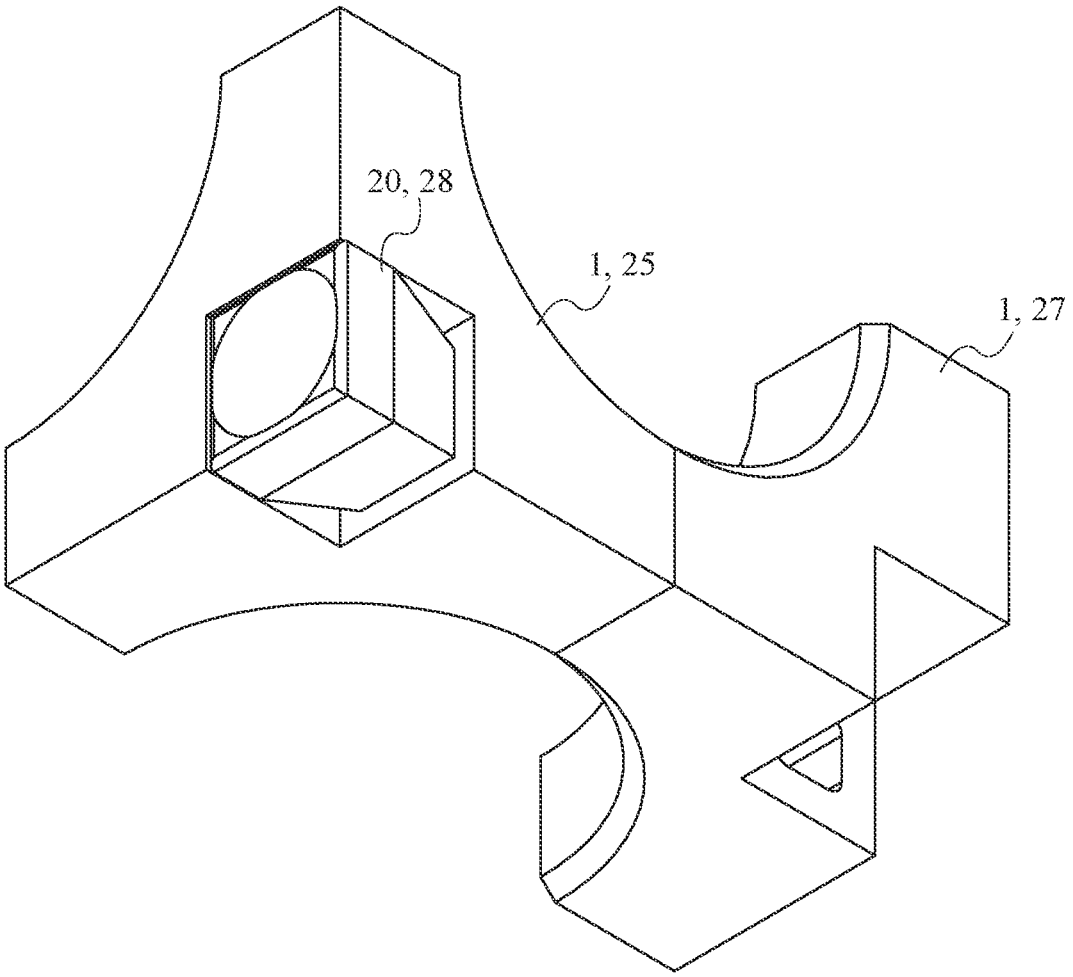
FIG. 13 is a bottom perspective view of two interlocking pieces of the present invention connected by a golf tee.
Figure 14:
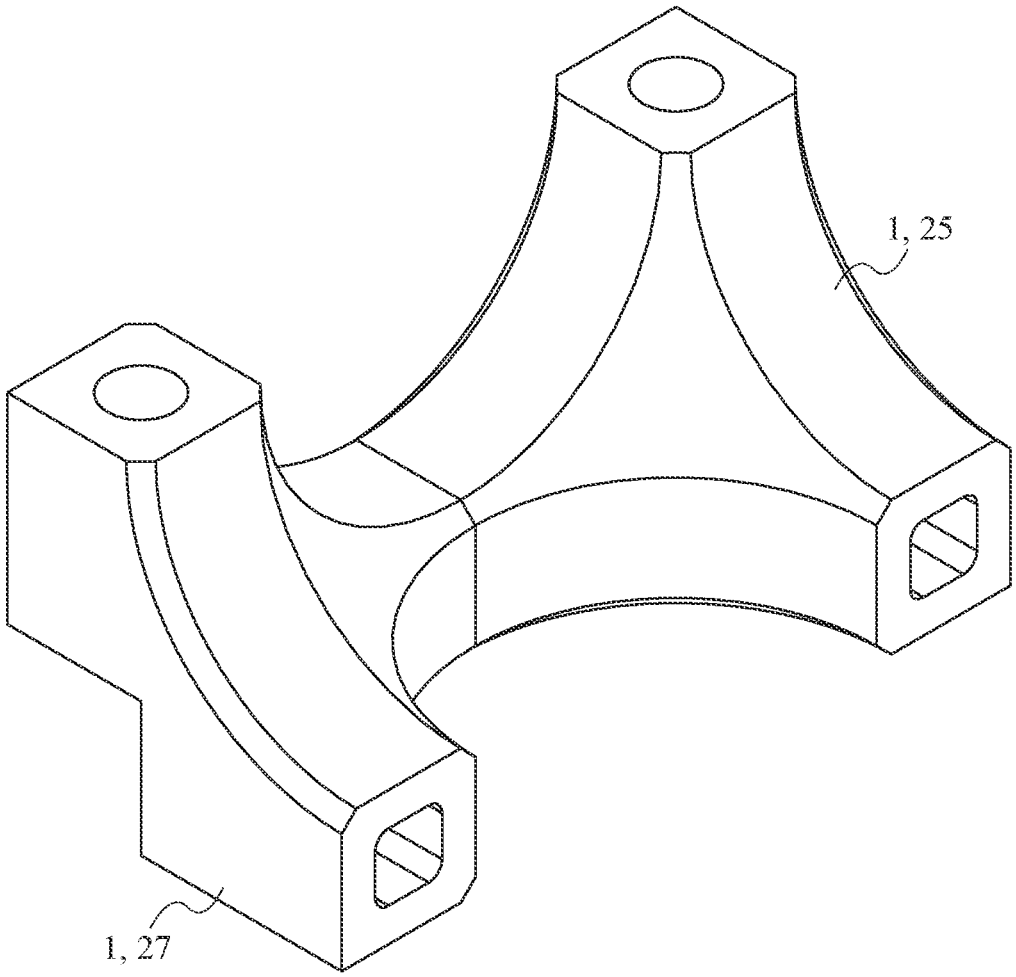
FIG. 14 is a top perspective view of two interlocking pieces of the present invention connected by a golf tee.
Figure 15:
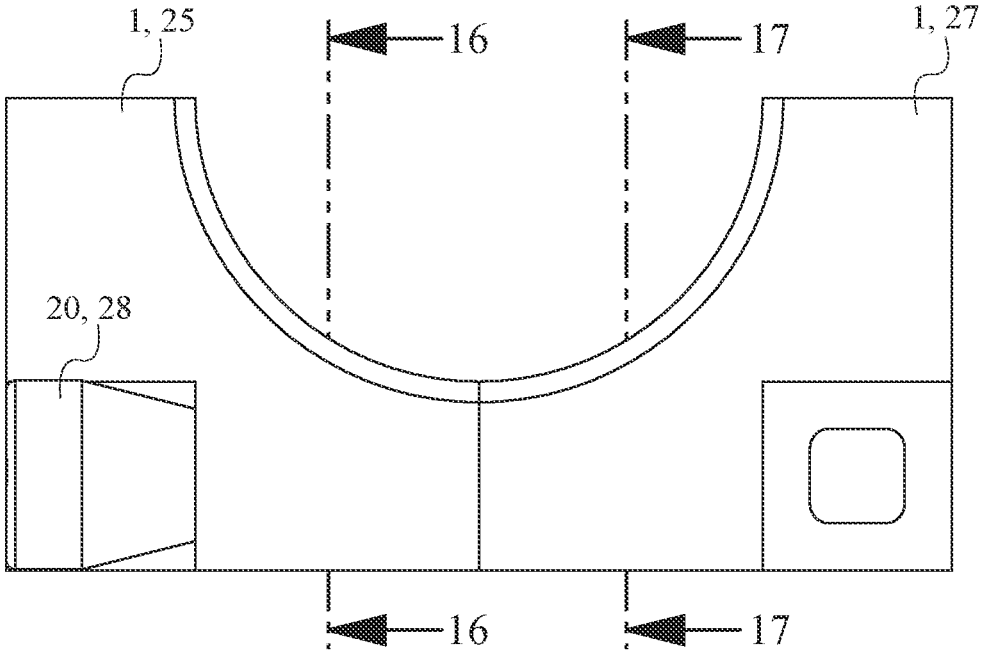
FIG. 15 is a side view of two interlocking pieces of the present invention connected by a golf tee.
Figure 16:
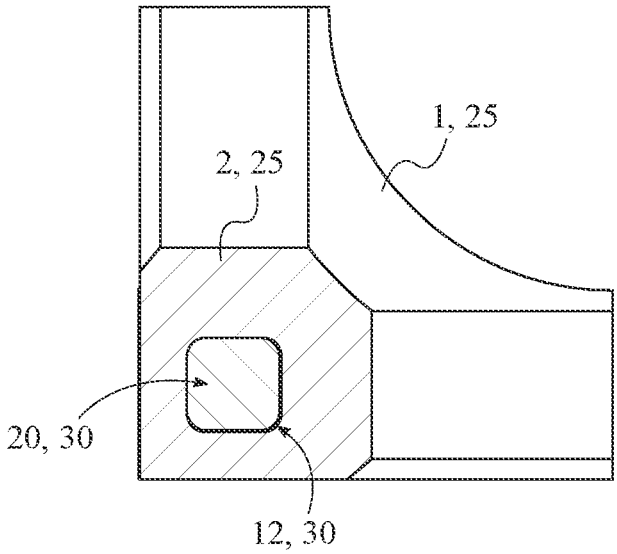
FIG. 16 is a vertical cross-sectional view of the arbitrary interlocking piece of the present invention taken along line 15-15 in FIG. 15.
Figure 17:
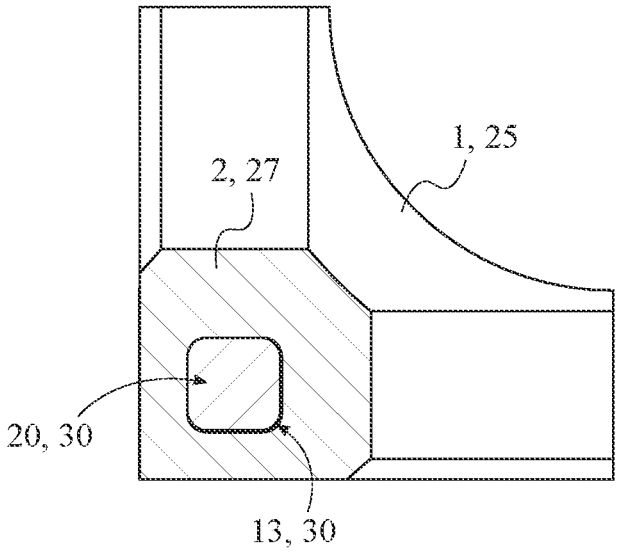
FIG. 17 is a vertical cross-sectional view of the adjacent interlocking piece of the present invention taken along line 17-17 in FIG. 15.
Figure 18:
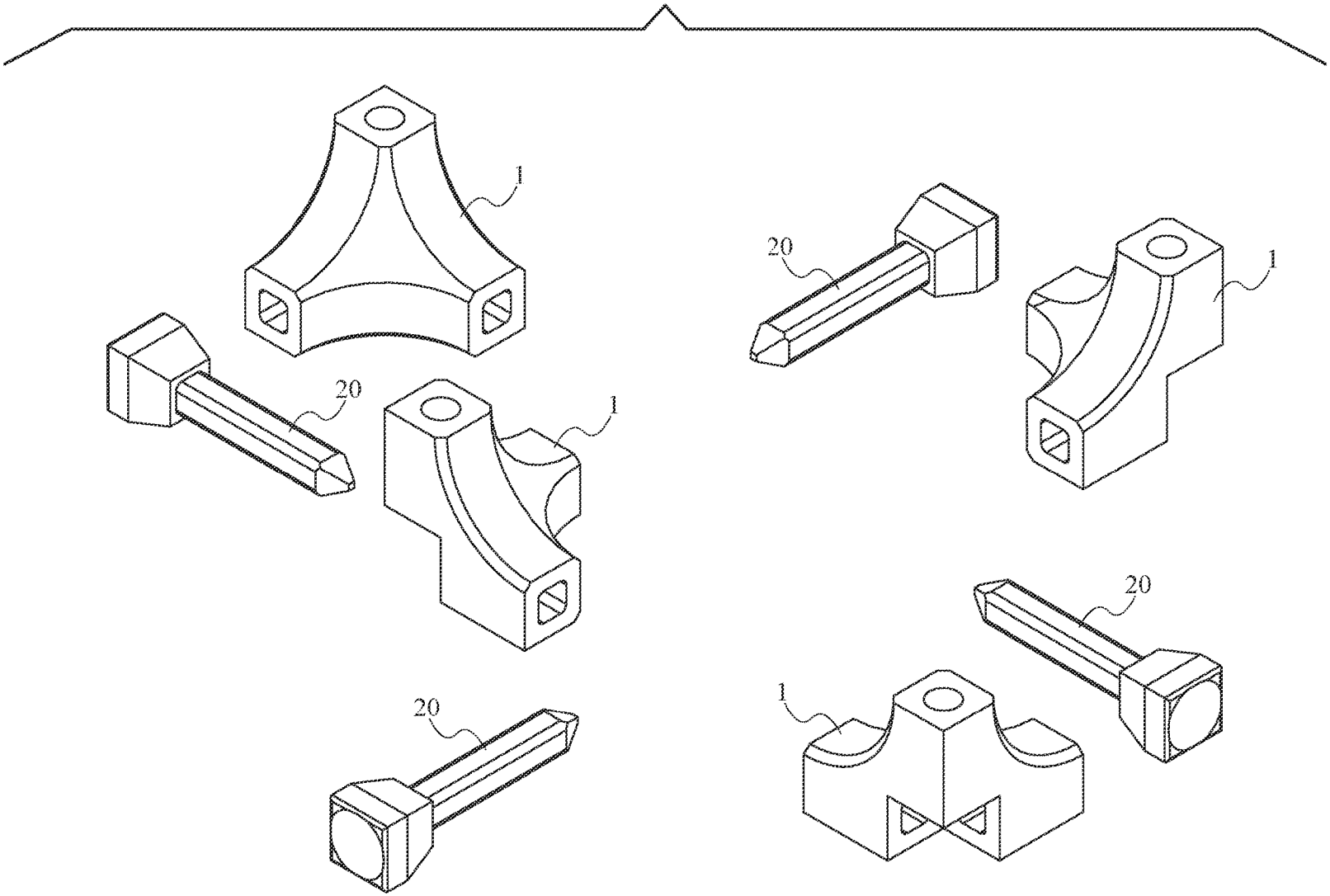
FIG. 18 is a top exploded perspective view of four interlocking pieces of the present invention connected by four golf tees.
Figure 19:
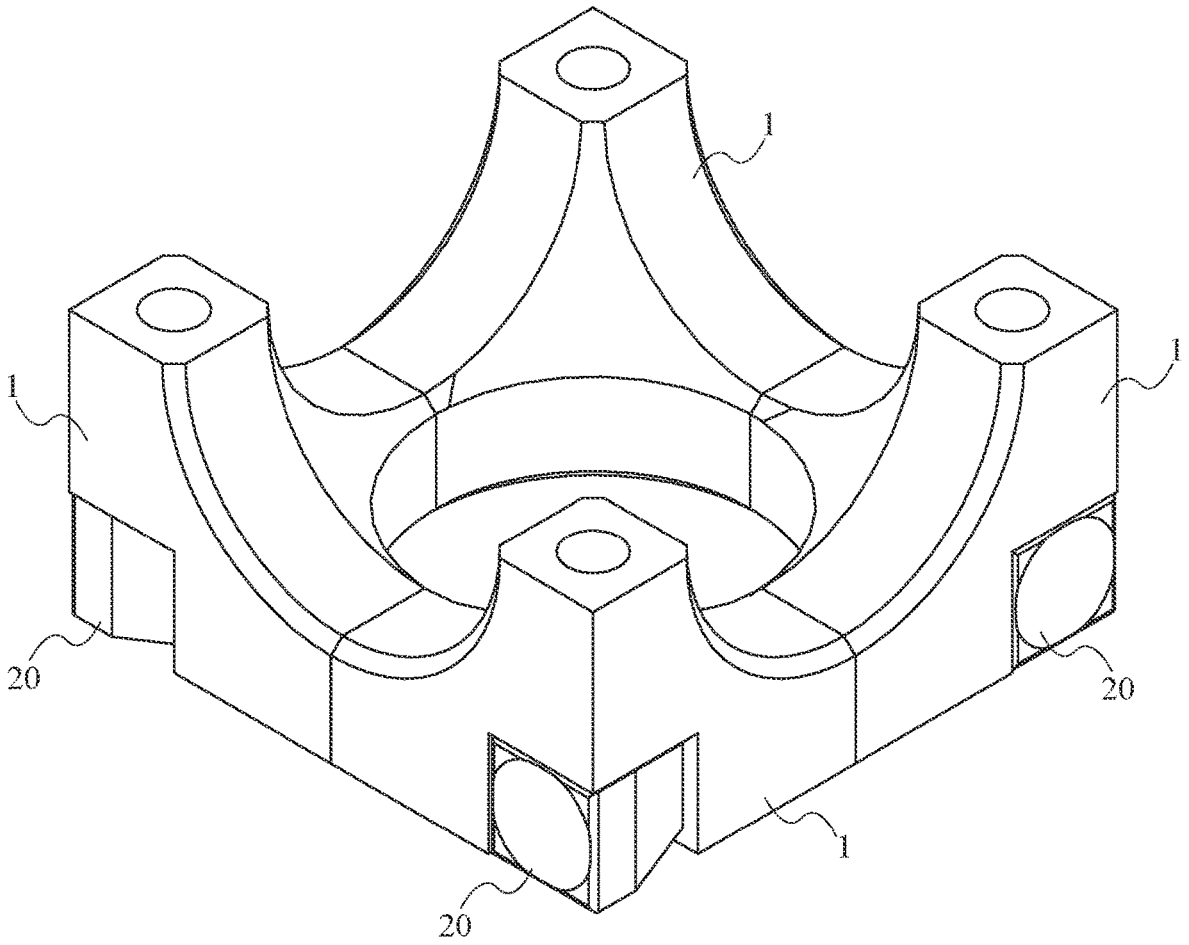
FIG. 19 is a top perspective view of four interlocking pieces of the present invention connected by four golf tees.
Figure 20:
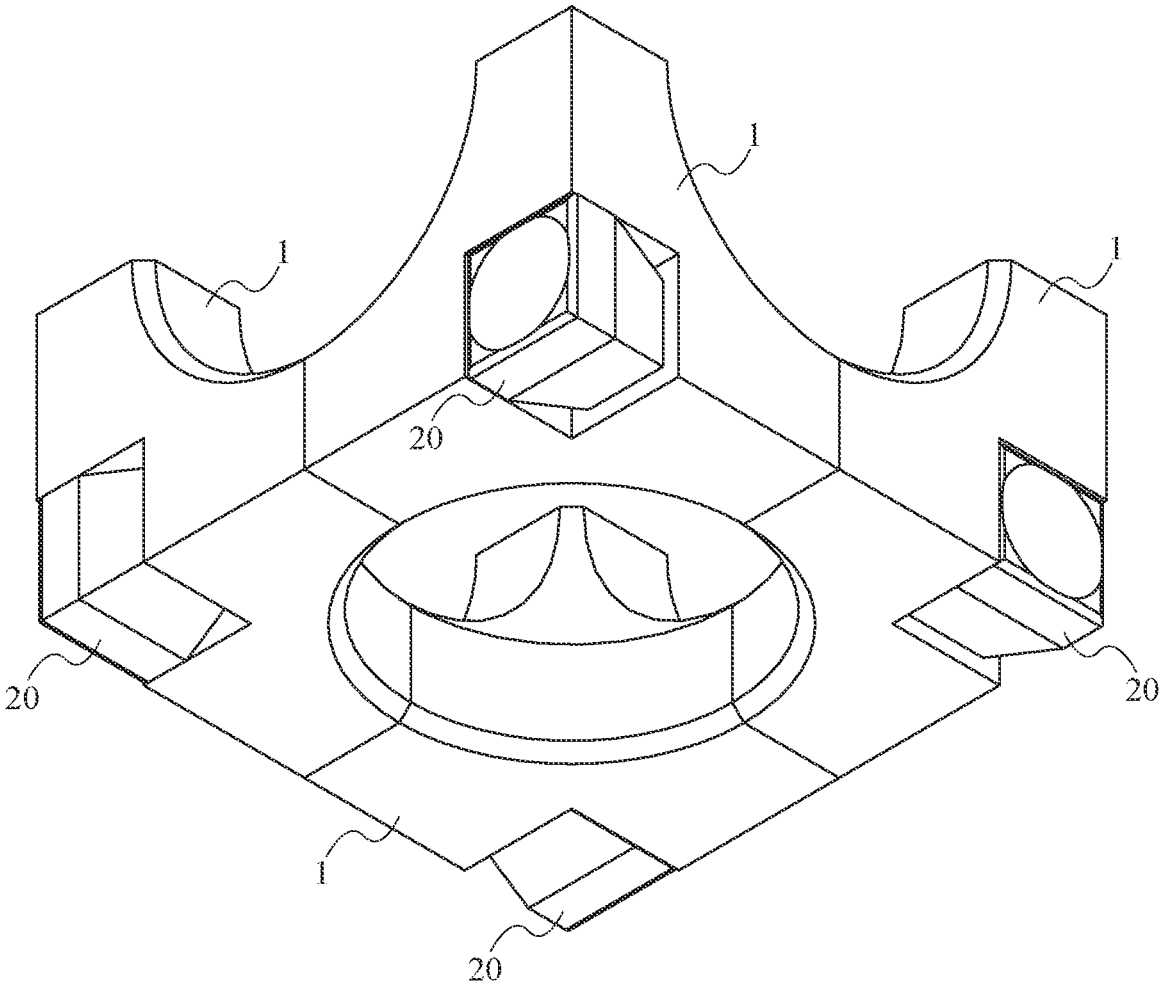
FIG. 20 is a bottom perspective view of four interlocking pieces of the present invention connected by four golf tees.
Figure 21:
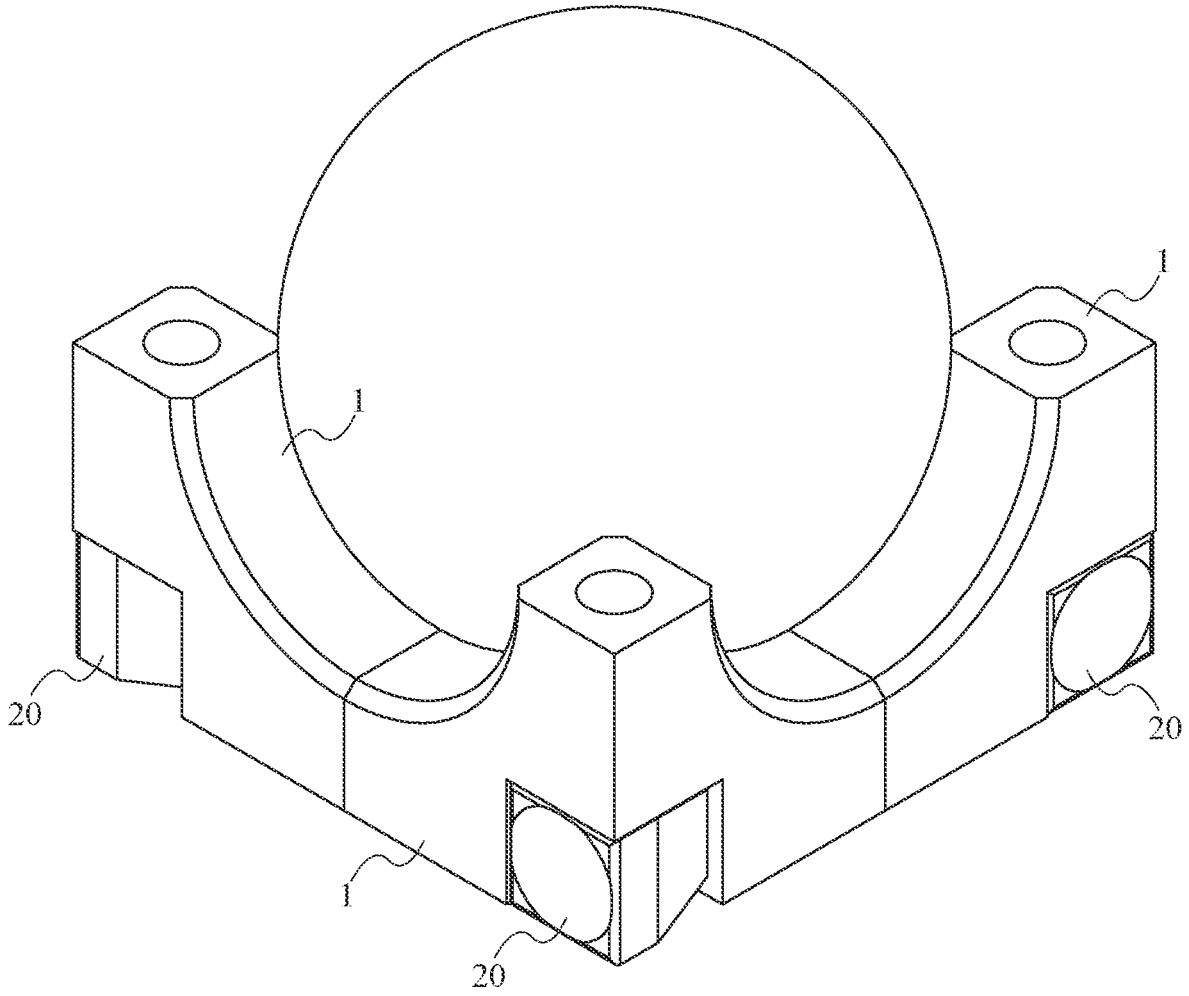
FIG. 21 is a top perspective view of four interlocking pieces of the present invention connected by four golf tees, wherein a golf ball is shown supported by the present invention.
Figure 22:
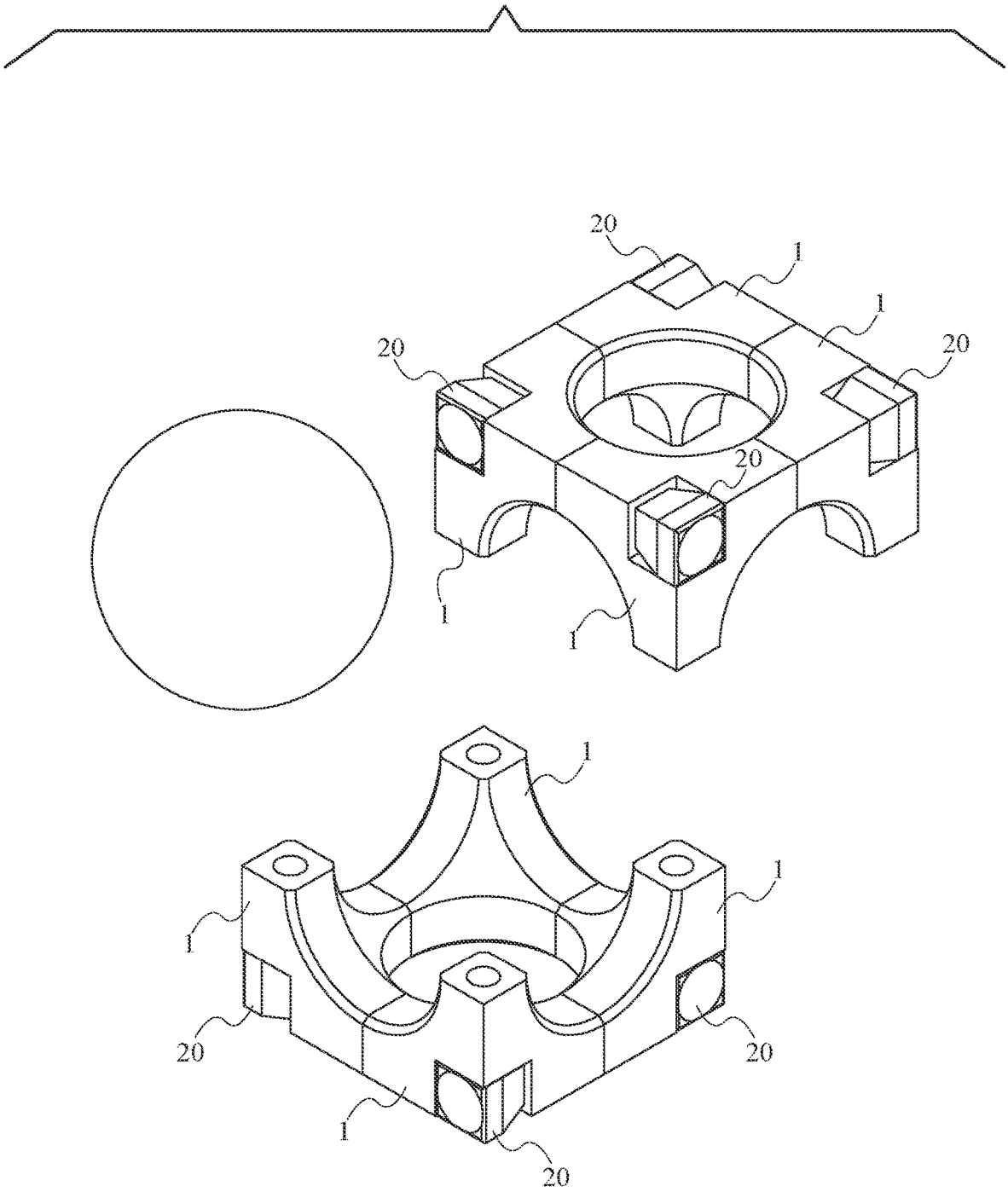
FIG. 22 is a top exploded perspective view of the present invention, wherein the present invention is shown in a gift box configuration, and wherein a golf ball is shown retained by the present invention.
Figure 23:
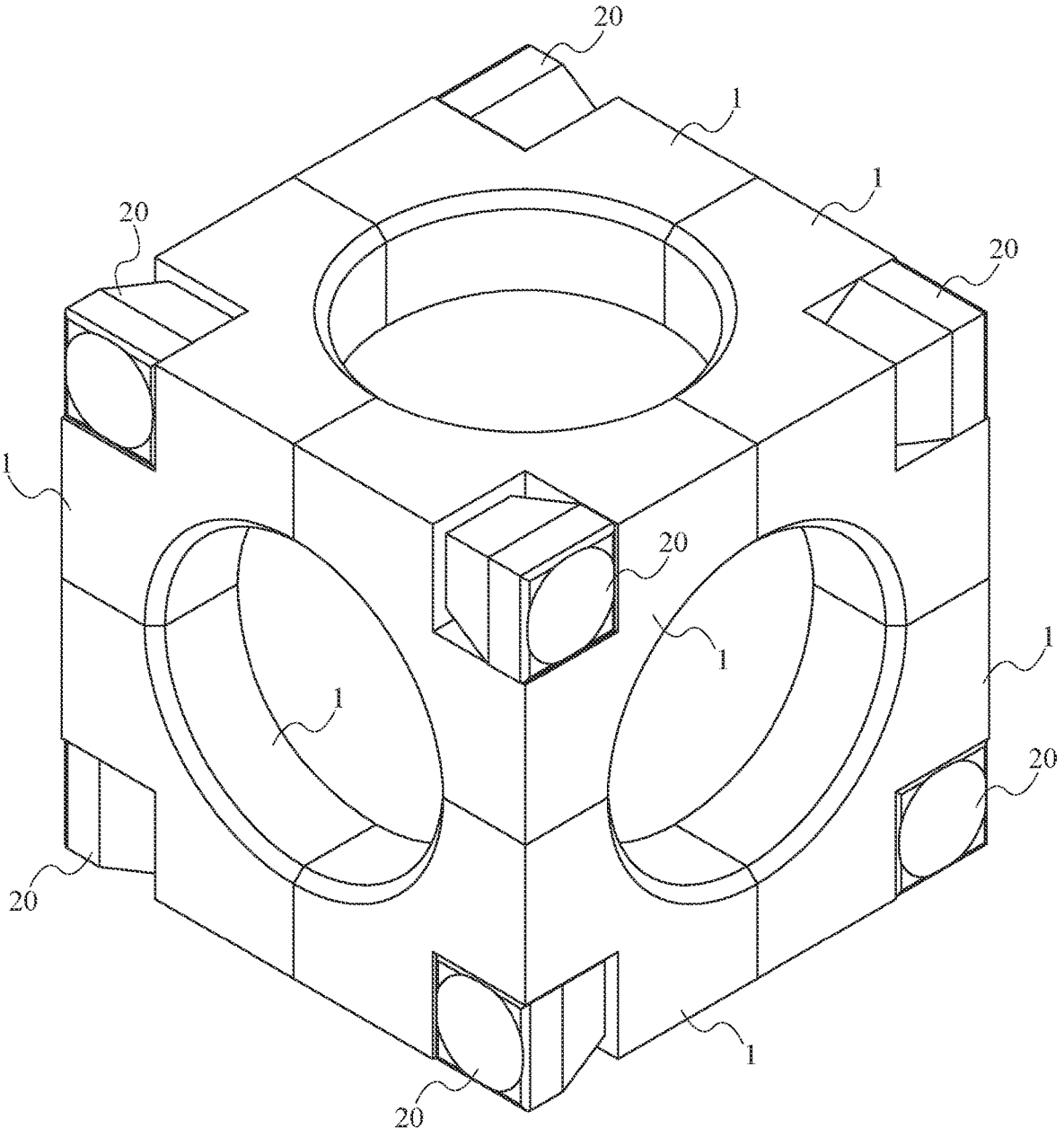
FIG. 23 is a top perspective view of the present invention, wherein the present invention is shown in a gift box configuration, and wherein a golf ball is shown retained by the present invention.

The present invention is a golf tee nest. The present invention is designed to help golf enthusiasts practice different golf skills as well as to serve as a storage box or a gift box for one or more golf balls. As can be seen in FIG. 12 through 23, the present invention comprises a plurality of interlocking pieces 1 and a plurality of golf tees 20. The plurality of interlocking pieces 1 corresponds to several triangular-shaped retaining pieces that can hold a golf ball in different ways for different golf-related activities. The plurality of interlocking pieces 1 is also designed to be rearranged into different configurations to facilitate the different golf-related activities that the user can perform with the present invention. The plurality of golf tees 20 corresponds to several golf tees specially designed to facilitate the coupling of the plurality of interlocking pieces 1 in different configurations. The plurality of golf tees 20 can also be utilized alone to perform different golf-related activities.

Figure 1:
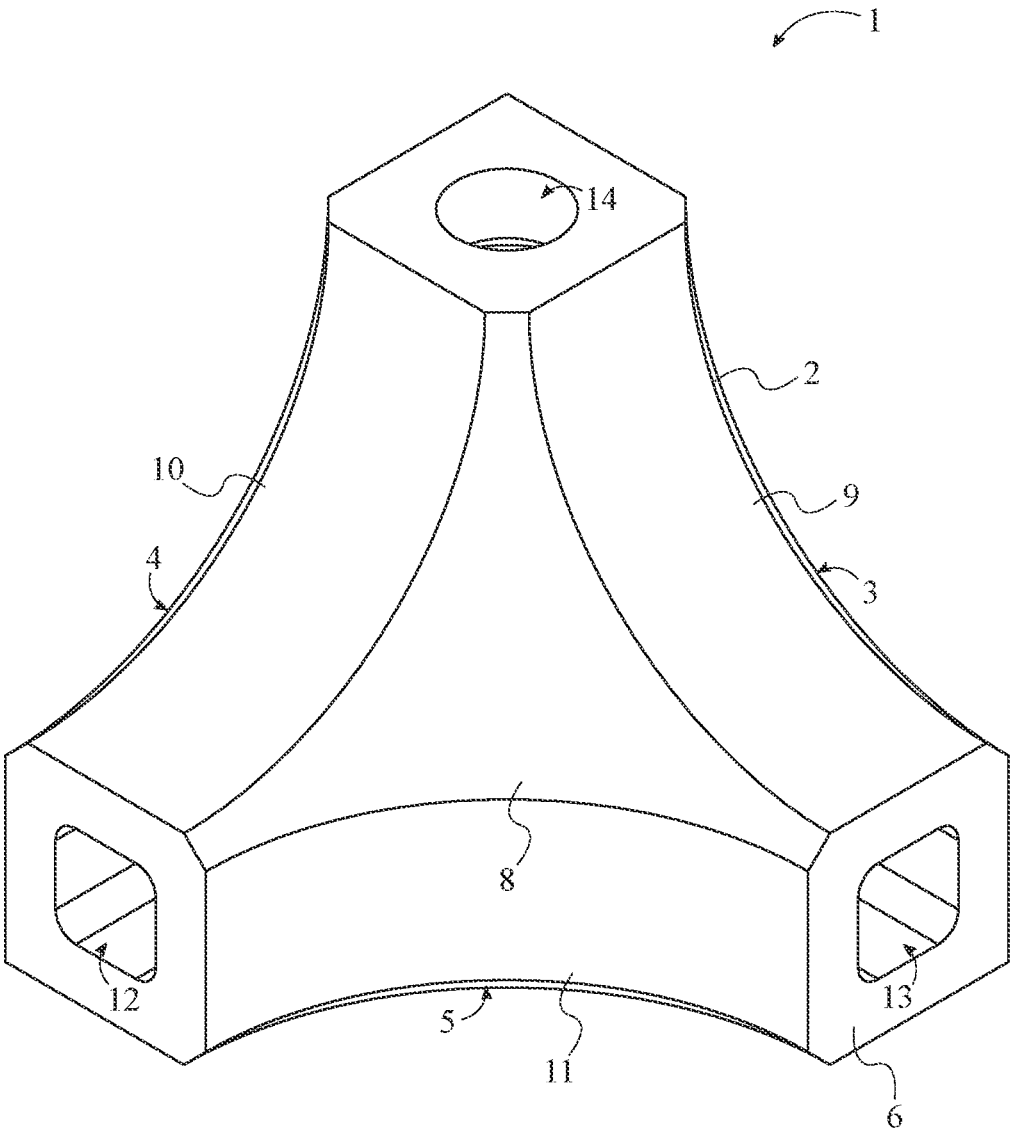
FIG. 1 is a top perspective view of an interlocking piece of the present invention.
Figure 2:
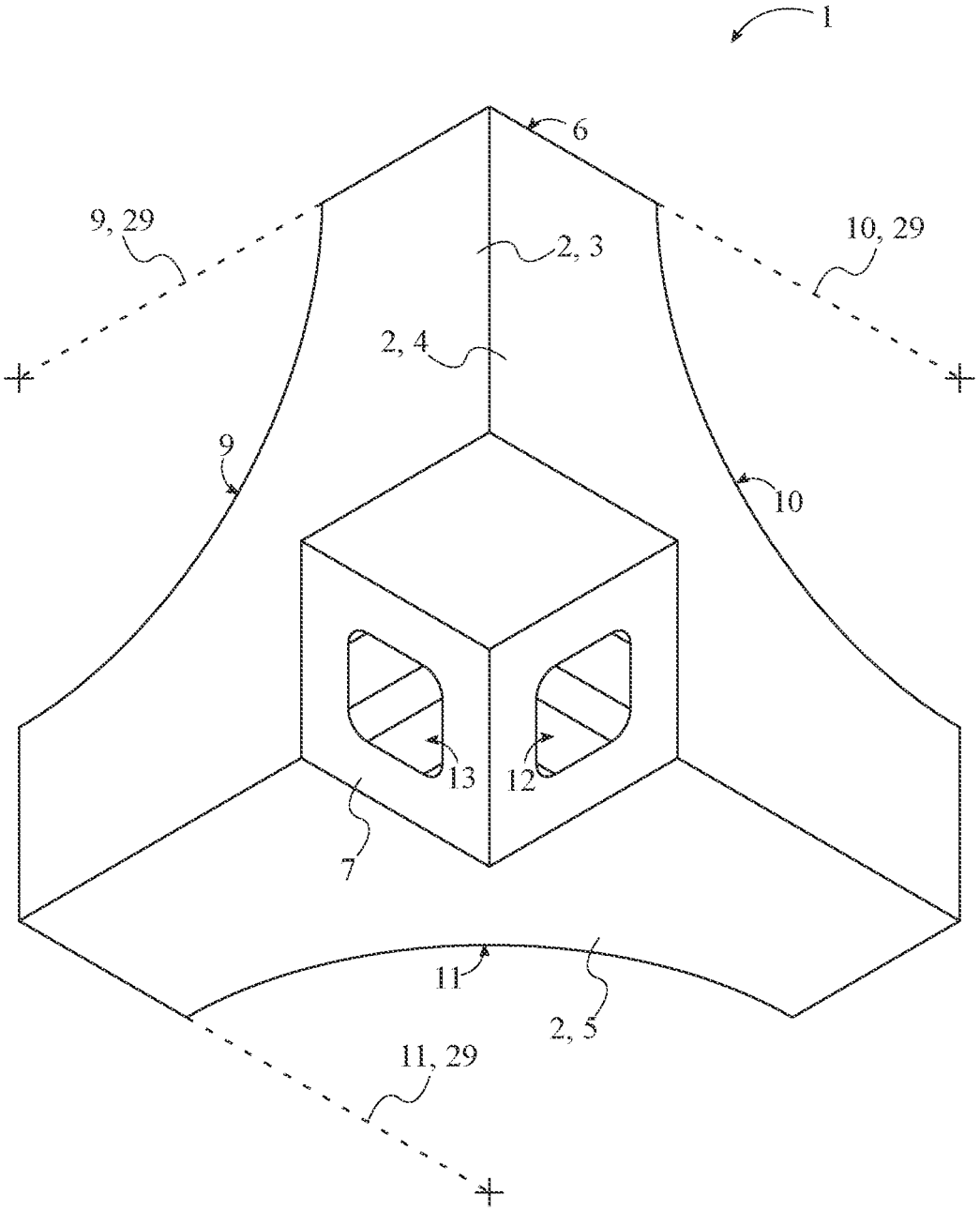
FIG. 2 is a bottom perspective view of an interlocking piece of the present invention.
Figure 3:
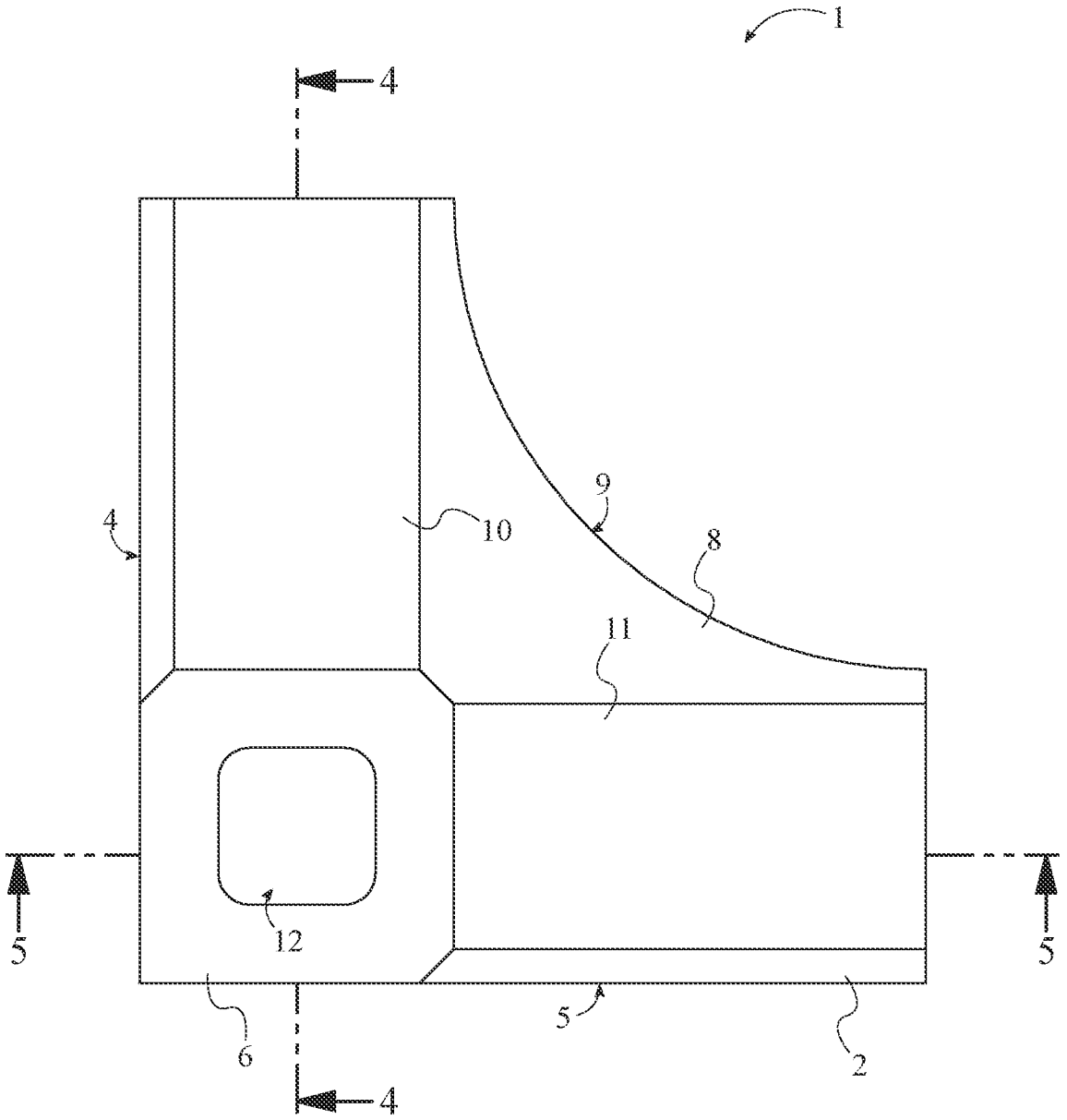
FIG. 3 is a side view of an interlocking piece of the present invention.
Figure 4:
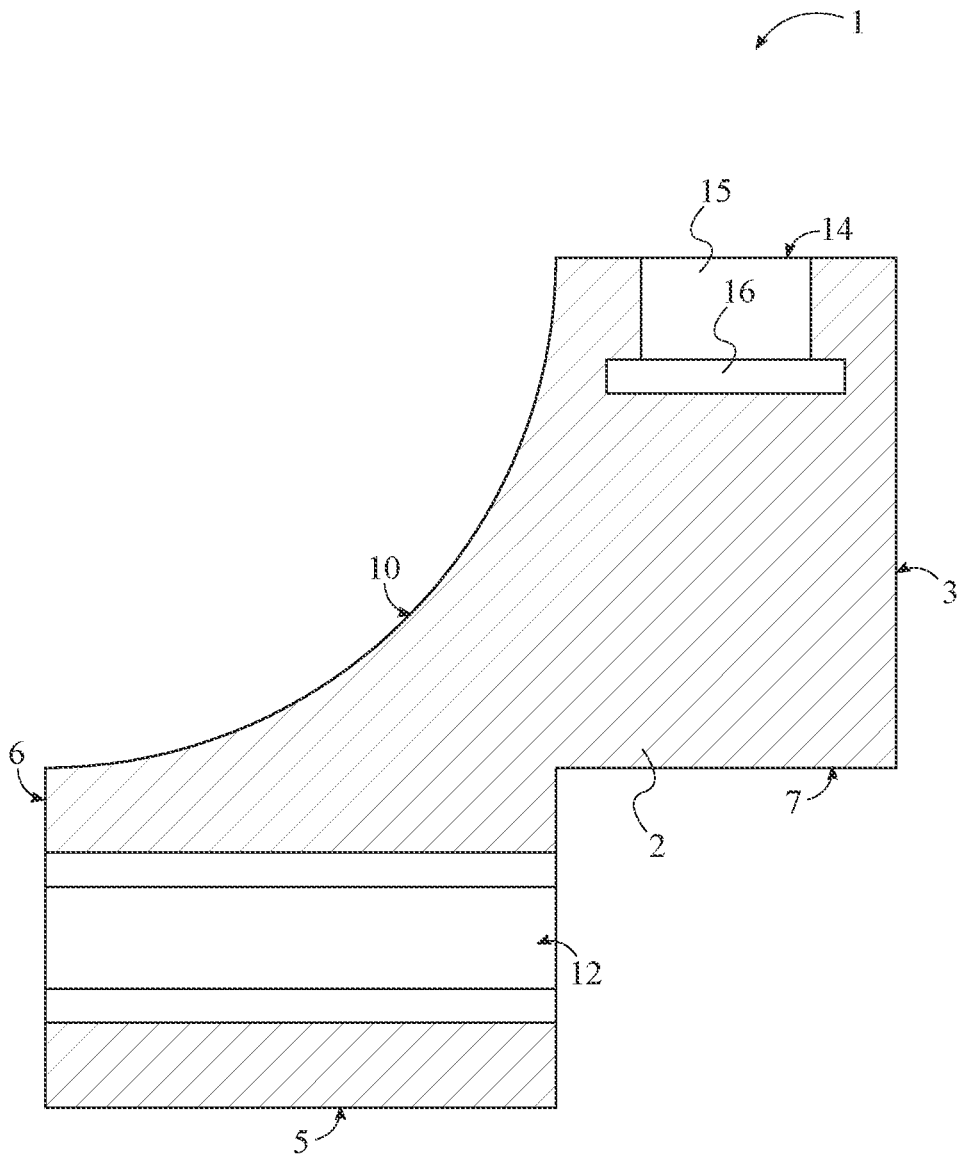
FIG. 4 is a vertical cross-sectional view of an interlocking piece of the present invention taken along line 4-4 in FIG. 3.
Figure 5:
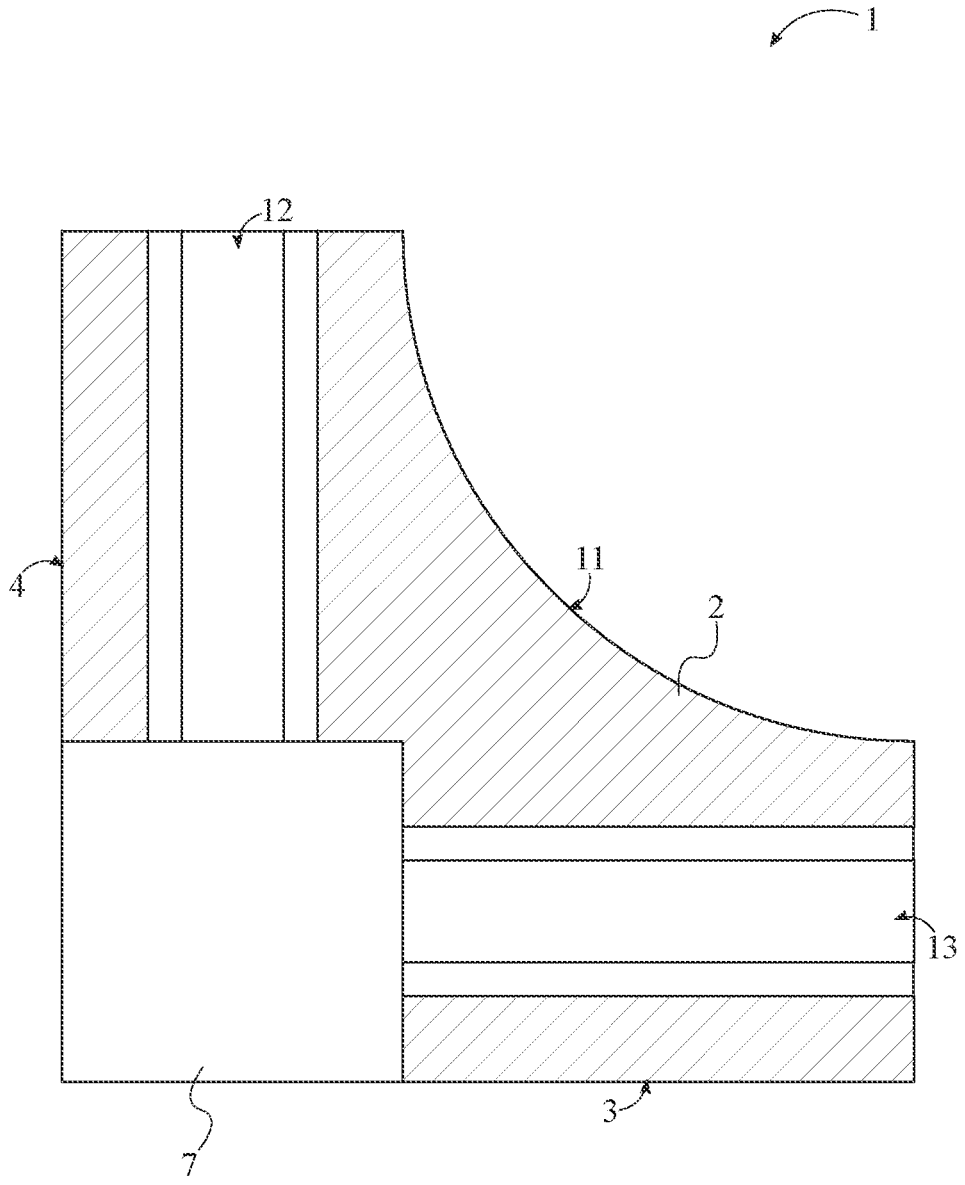
FIG. 5 is a horizontal cross-sectional view of an interlocking piece of the present invention taken along line 5-5 in FIG. 3.

The general configuration of the aforementioned components enables users to perform different golf exercises to practice different golf skills. As previously discussed, each of the plurality of interlocking pieces 1 is triangular-shaped to enable the construction of a polygonal structure that can retain or support one or more golf balls. As can be seen in FIG. 1 through 5, each of the plurality of interlocking pieces 1 comprises a triangular body 2, a first tee hole 12, a second tee hole 13, at least one magnet hole 14, and at least one magnet 17. The triangular body 2 corresponds to the overall structure of each of the plurality of interlocking pieces 1. The first tee hole 12 and the second tee hole 13 correspond to the holes that accommodate the plurality of golf tees 20 to couple several interlocking pieces together. The at least one magnet hole 14 corresponds to a separate hole that accommodates the at least one magnet 17. The at least one magnet 17 enables the removable coupling of the plurality of interlocking pieces 1 to each other. Further, the triangular body 2 is designed to enable the construction of the polygonal structure that can hold one or more golf balls. To do so, the triangular body 2 comprises a first body face 3, a second body face 4, a third body face 5, a body base 6, a body recession 7, and a base recession 8. The first body face 3, the second body face 4, and the third body face 5 correspond to three congruent surfaces of the triangular body 2. The body base 6 corresponds to the larger surface of the triangular body 2. Further, the body recession 7 corresponds to a recession that enables each of the plurality of interlocking pieces 1 to be used as a golf tee, while the base recession 8 provides a holding space to support or retain a golf ball.

Figure 8:
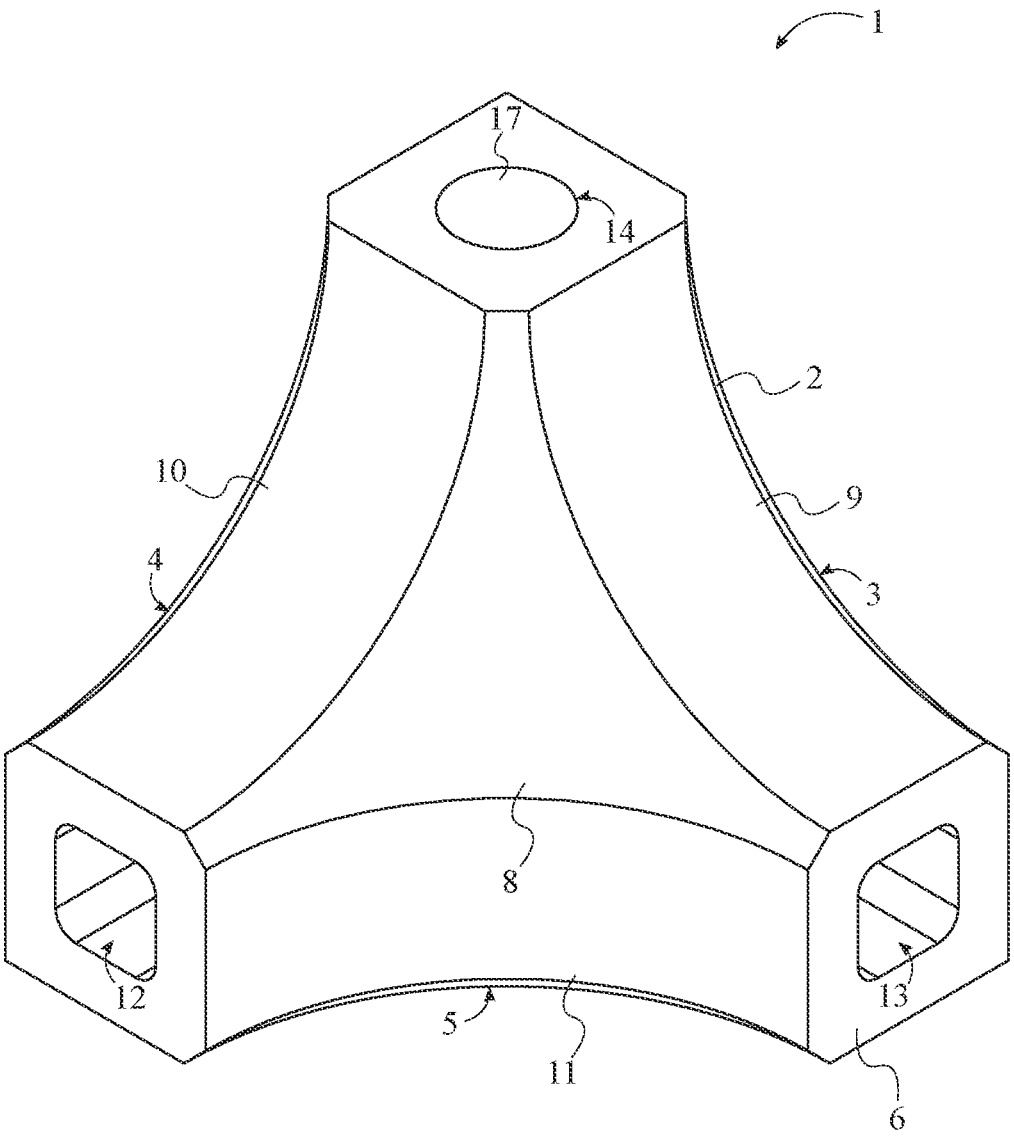
FIG. 8 is a top perspective view of an interlocking piece of the present invention, wherein the interlocking piece is shown with a magnet.
Figure 9:
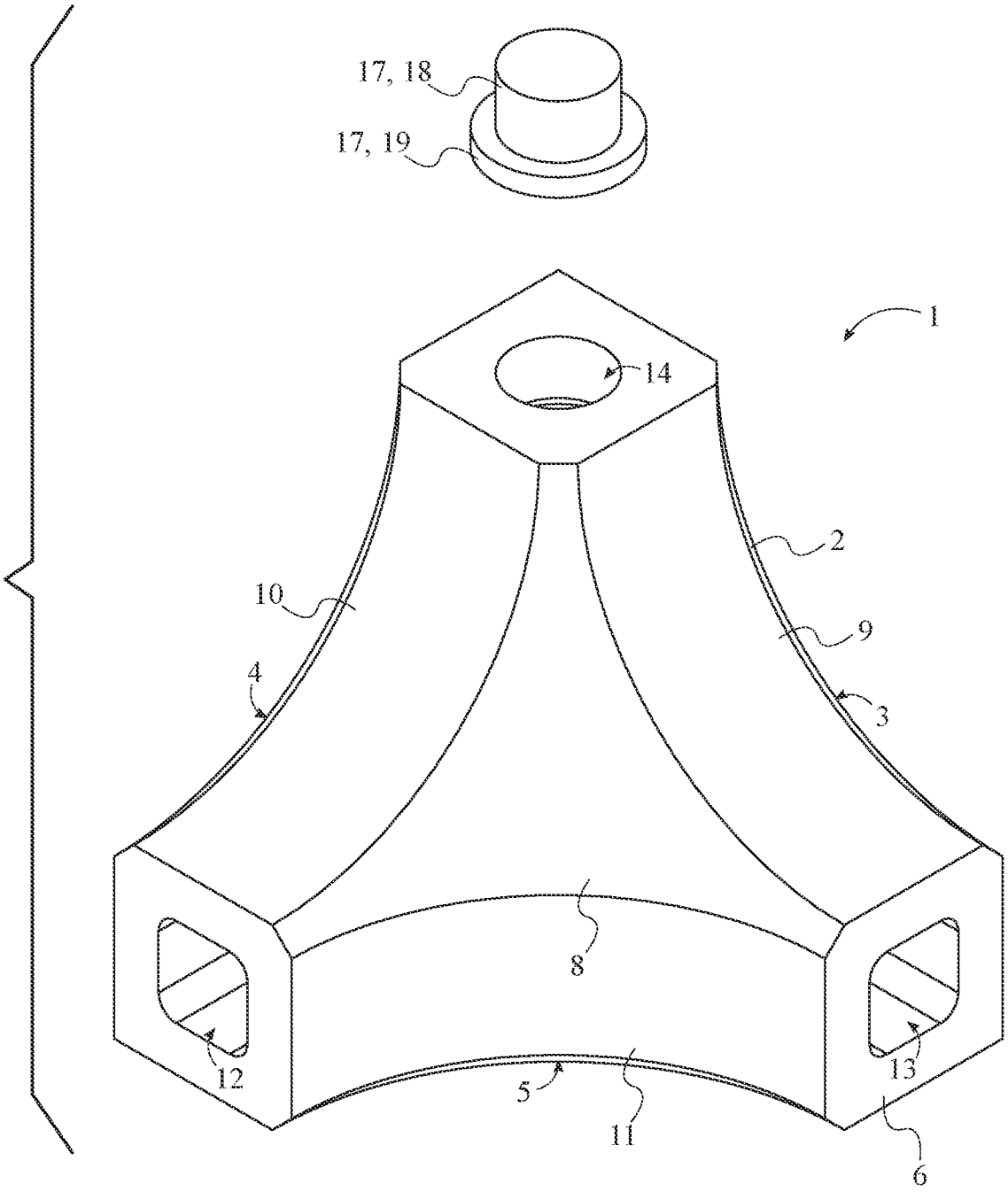
FIG. 9 is a top exploded perspective view of an interlocking piece of the present invention.
Figure 10:
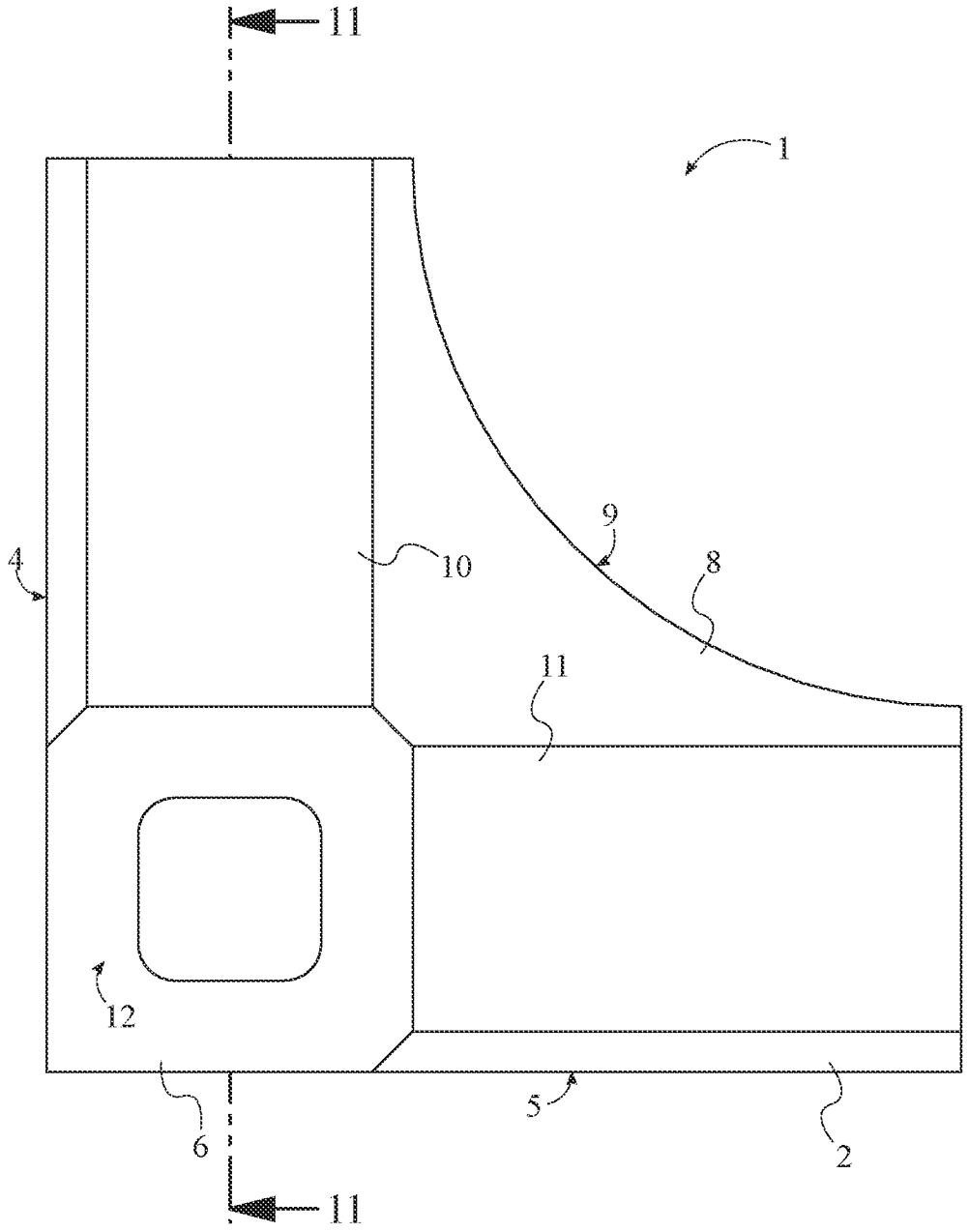
FIG. 10 is a side view of an interlocking piece of the present invention.
Figure 11:
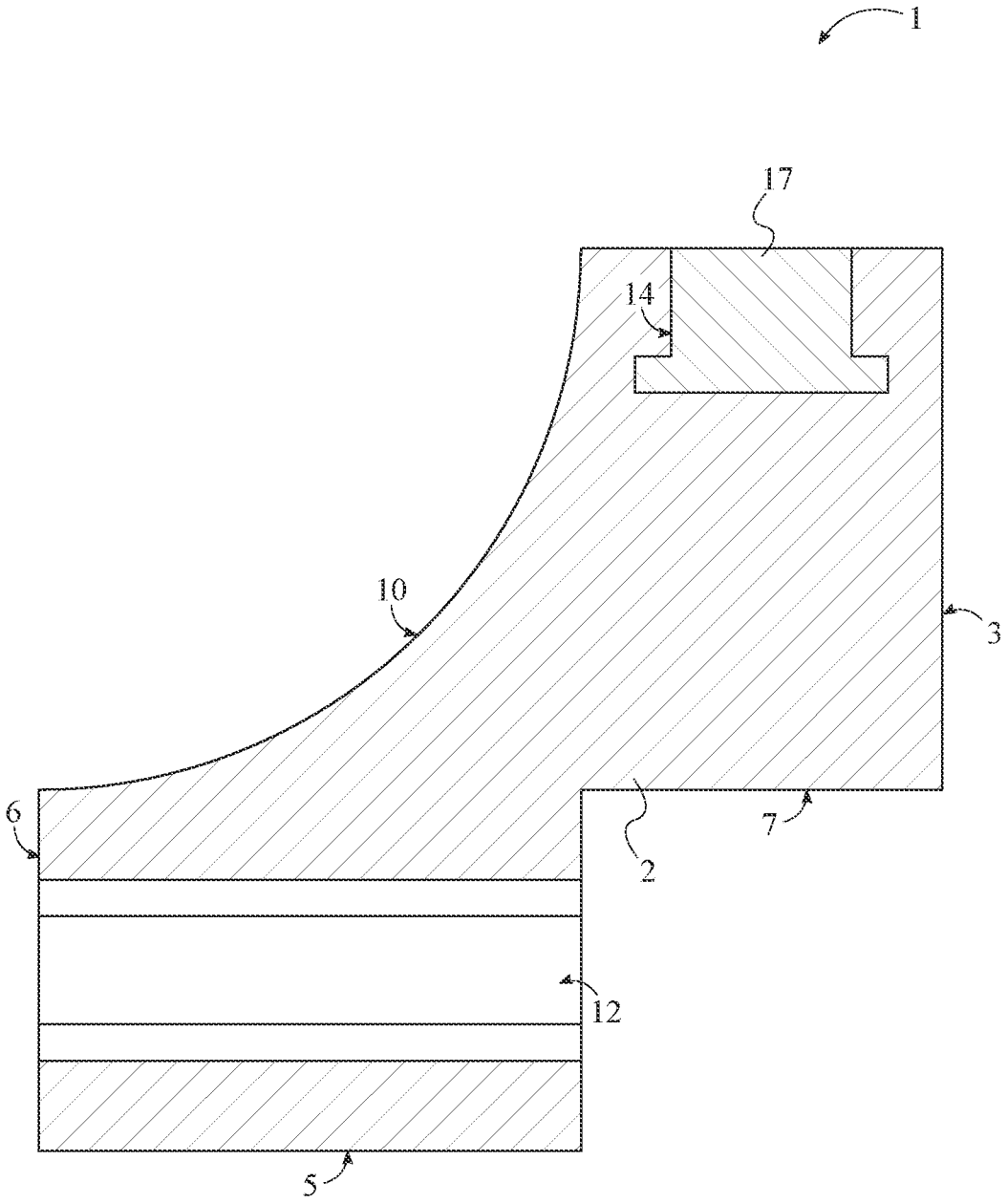
FIG. 11 is a vertical cross-sectional view of an interlocking piece of the present invention taken along line 11-11 in FIG. 10.

In the preferred embodiment, the present invention can be arranged as follows. As can be seen in FIG. 1 through 5 and 8 through 11, the body recession 7 traverses into the triangular body 2, opposite to the body base 6, to provide a space that can support a portion of the golf ball. The body recession 7 also enables the insertion of a golf tee of the plurality of golf tees 20 into either the first tee hole 12 or the second tee hole 13. The first tee hole 12 is positioned adjacent to the second body face 4 to guide the golf tee along the second body face 4. Further, the first tee hole 12 traverses from the first body face 3, through the body recession 7, and through the triangular body 2. This way, the golf tee of the plurality of golf tees 20 can be inserted through the triangular body 2 along the second body face 4. Similarly, the second tee hole 13 is positioned adjacent to the first body face 3 to guide the golf tee along the first body face 3. Further, the second tee hole 13 traverses from the second body face 4, through the body recession 7, and through the triangular body 2. This way, the golf tee of the plurality of golf tees 20 can be inserted through the triangular body 2 along the first body face 3. Further, the base recession 8 traverses into the triangular body 2 from the body base 6 to provide a space to hold or support a golf ball. The base recession 8 is preferably a circular recession with a radius 29 large enough to accommodate the diameter of the golf ball. Further, the at least one magnet hole 14 traverses from the body base 6 into the triangular body 2, opposite to the third body face 5, to accommodate the at least one magnet 17. The at least one magnet 17 is also mounted within the at least one magnet hole 14 to secure the at least one magnet 17 within the at least one magnet hole 14. This way, two interlocking pieces can be coupled together by placing the magnets of each interlocking piece adjacent and near each other.

Furthermore, as can be seen in FIG. 12 through 23, the plurality of interlocking pieces 1 can be coupled together by aligning an arbitrary tee hole 24 of an arbitrary interlocking piece 25 with a corresponding tee hole 26 of an adjacent interlocking piece 27 from the plurality of interlocking pieces 1. Then, a selected golf tee 28 from the plurality of golf tees 20 is inserted through the arbitrary tee hole 24 of the arbitrary interlocking piece 25 and into the corresponding tee hole 26 of the adjacent interlocking piece 27 to couple the arbitrary interlocking piece 25 and the adjacent interlocking piece 27. This way, two interlocking pieces 1 can be coupled together using a golf tee 20 and the base recessions 8 form a semi hemisphere recession. Four interlocking pieces 1 can be coupled together using four golf tees 20 and the base recessions 8 form a hemisphere. Further, two clusters of four interlocking pieces 1 coupled together can be attached to each other using the magnets 17 on the interlocking pieces 1 to form a cube structure that can be used as a gift box. In the gift box configuration, the base recessions 8 of the cube structure form an internal sphere recession that can hold a golf ball so that the present invention can be used as a gift box. Further, the triangular body 2 can be made of different materials with different ornamental designs that make the present invention better suited to be used as a gift box. In other embodiments, different structures can be formed using the plurality of interlocking pieces 1 in different arrangements to support one or more golf balls.

As previously discussed, each of the plurality of interlocking pieces 1 is designed to accommodate a golf ball. In addition to the base recession 8, the triangular body 2 can be further designed to accommodate the golf ball. As can be seen in FIG. 1 through 5 and 21 through 23, the triangular body 2 may further comprise a first circular cutout 9, a second circular cutout 10, and a third circular cutout 11. The first circular cutout 9, the second circular cutout 10, and the third circular cutout 11 are designed to enable the golf ball to perfectly fit on the base recession 8. The first circular cutout 9, the second circular cutout 10, and the third circular cutout 11 also enable the golf ball to be visible when the golf ball is retained by the present invention in the gift box configuration. Accordingly, the first circular cutout 9 is positioned equidistant from the second body face 4 and the third body face 5. The first circular cutout 9 also traverses from the first body face 3 through the triangular body 2, adjacent to the body base 6. This way, the first circular cutout 9 leaves a round opening on the first body face 3 adjacent to the body base 6 to accommodate the round body of the golf ball. Likewise, the second circular cutout 10 is positioned equidistant from the first body face 3 and the third body face 5. The second circular cutout 10 also traverses from the second body face 4 through the triangular body 2, adjacent to the body base 6. This way, the second circular cutout 10 leaves a round opening on the second body face 4 adjacent to the body base 6 to further accommodate the round body of the golf ball. Likewise, the third circular cutout 11 is positioned equidistant from the first body face 3 and the second body face 4. The third circular cutout 11 also traverses from the third body face 5 through the triangular body 2, adjacent to the body base 6. This way, the second circular cutout 10 leaves a round opening on the second body face 4 adjacent to the body base 6 to further accommodate the round body of the golf ball. Thus, three similar round openings on each of the congruent surfaces of the triangular body 2 are formed that accommodate the round body of the golf ball when the golf ball is placed on the base recession 8. Furthermore, a radius 29 of the first circular cutout 9, a radius 29 of the second circular cutout 10, and a radius 29 of the third circular cutout 11 may be equal to each other, which results in a symmetrical triangular shape with a size that can accommodate a golf ball for the different activities that can be performed using the present invention.

The first tee hole 12 and the second tee hole 13 are designed to enable the coupling of the interlocking pieces 1 in a linear arrangement to facilitate the construction of polygonal structures using the plurality of interlocking pieces 1. As can be seen in FIG. 1 through 5, the first tee hole 12 is positioned parallel to the second body face 4 and the third body face 5 so that the golf tee is guided straight through the triangular body 2 along the second body face 4 and the third body face 5. In addition, the first tee hole 12 is positioned equidistant from the second body face 4 and the third body face 5 to place the first tee hole 12 adjacent to the edge of the triangular body 2 where the second body face 4 and the third body face 5 intersect. Similarly, the second tee hole 13 is positioned parallel to the first body face 3 and the third body face 5 so that the golf tee is guided straight through the triangular body 2 along the first body face 3 and the third body face 5. In addition, the second tee hole 13 is positioned equidistant from the first body face 3 and the third body face 5 to place the second tee hole 13 adjacent to the edge of the triangular body 2 where the first body face 3 and the third body face 5 intersect. This way, when the arbitrary interlocking piece 25 is coupled to the adjacent interlocking piece 27 by the selected golf tee 28 inserted through the first tee hole 12 of the arbitrary interlocking piece 25, the second body face 4 of the arbitrary interlocking piece 25 and the first body face 3 of the adjacent interlocking piece 27 are coplanar to each other. The third body face 5 of the arbitrary interlocking piece 25 and the third body face 5 of the adjacent interlocking piece 27 are also coplanar to each other. Alternatively, when the arbitrary interlocking piece 25 is coupled to the adjacent interlocking piece 27 by the selected golf tee 28 inserted through the second tee hole 13 of the arbitrary interlocking piece 25, the second body face 4 of the arbitrary interlocking piece 25 and the first body face 3 of the adjacent interlocking piece 27 are coplanar to each other. The third body face 5 of the arbitrary interlocking piece 25 and the third body face 5 of the adjacent interlocking piece 27 are also coplanar to each other.

Figure 6:
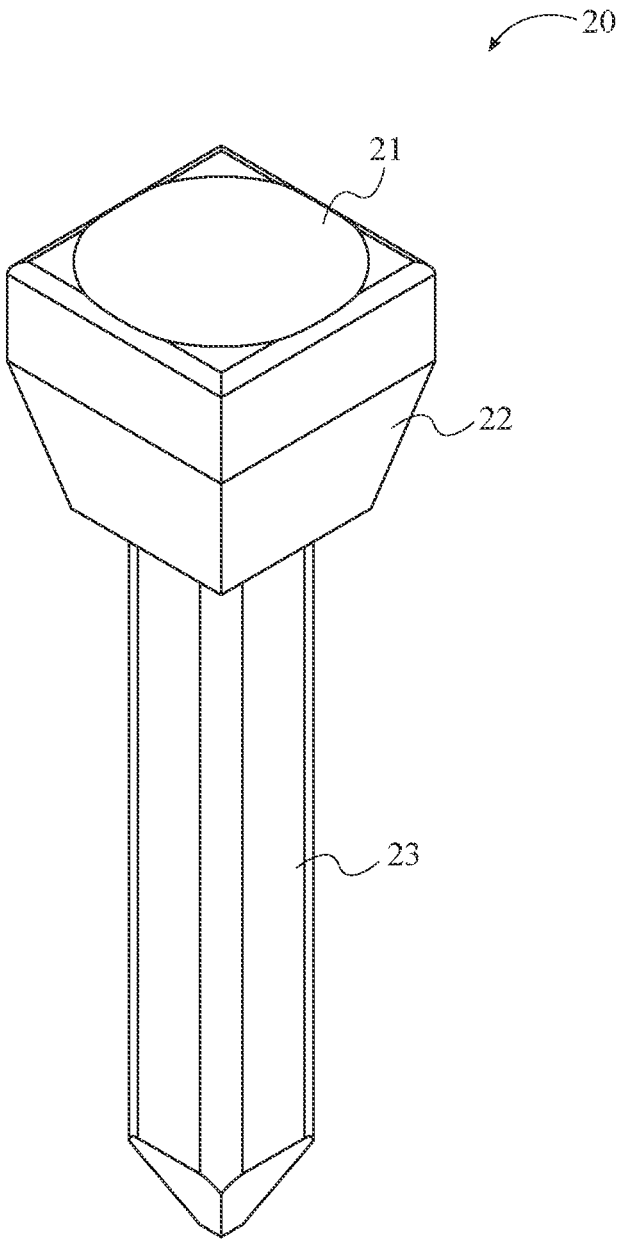
FIG. 6 is a top perspective view of a golf tee of the present invention.
Figure 7:
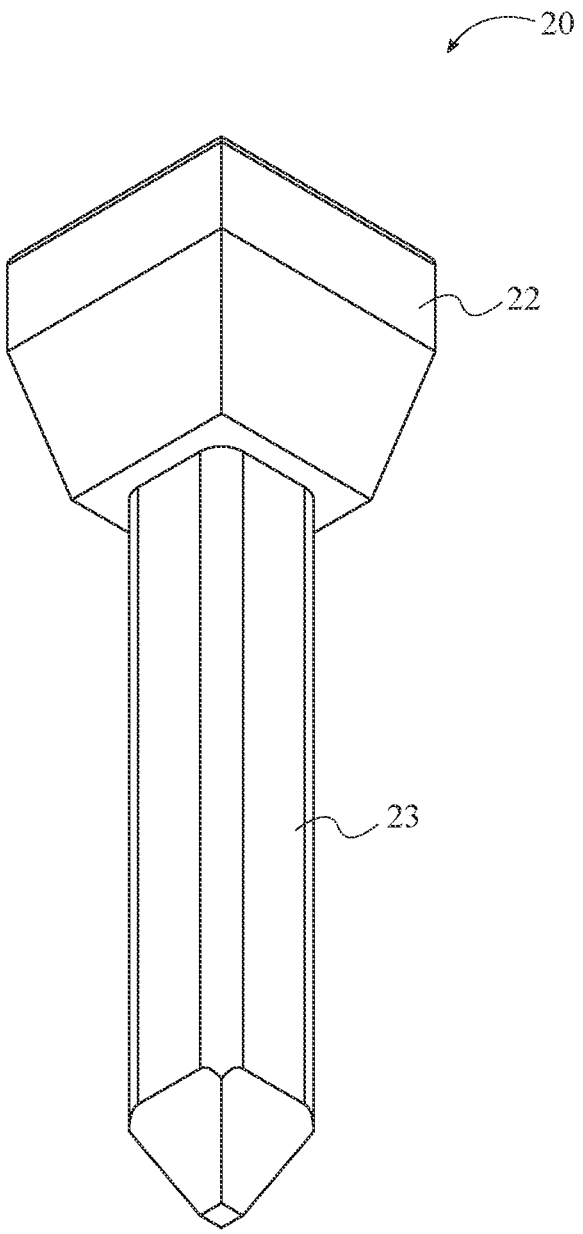
FIG. 7 is a bottom perspective view of a golf tee of the present invention.

As previously discussed, the plurality of golf tees 20 facilitates the coupling of the plurality of interlocking pieces 1 and can also be used as normal golf tees. As can be seen in FIGS. 6, 7, and 12 through 17, each of the plurality of golf tees 20 may comprise a ball-receiving recession 21, a tee head 22, and a tee spike 23. The tee spike 23 corresponds to the portion of the golf tee 20 that can be inserted through the first tee hole 12 or the second tee hole 13. The tee spike 23 also enables the golf tee 20 to be securely placed on the grass. The tee head 22 corresponds to the portion of the golf tee 20 that enables the safe insertion and removal of the tee spike 23 from the first tee hole 12 or second tee hole 13. The tee head 22 also supports the golf ball when the golf tee 20 is used as a normal golf tee. The ball-receiving recession 21 enables the balanced mounting of the golf ball on the tee head 22. Accordingly, the tee head 22 is terminally mounted to the tee spike 23 to form a single tee structure. The free end of the tee spike 23 is preferably a sharp end that facilitates the insertion of the tee spike 23 into the ground. Further, the ball-receiving recession 21 traverses into the tee head 22, opposite to the tee spike 23, to form a round recession on the tee head 22 that supports the golf ball when the golf ball is mounted onto the tee head 22 when the golf tee 20 is used as a normal golf tee. When a selected golf tee 28 is used to secure the coupling of the arbitrary interlocking piece 25 and the adjacent interlocking piece 27, the tee spike 23 of the selected golf tee 28 is inserted through the arbitrary tee hole 24 of the arbitrary interlocking piece 25 and into the corresponding tee hole 26 of the adjacent interlocking piece 27. Further, the tee head 22 of the selected golf tee 28 rests within the body recession 7 of the arbitrary interlocking piece 25 to maintain the polygonal shape of the built structure using the plurality of interlocking pieces 1. This way, the user can easily remove the selected golf tee 28 to uncouple the arbitrary interlocking piece 25 from the adjacent interlocking piece 27 by pulling the tee spike 23 from the tee head 22.

To ensure that the arbitrary interlocking piece 25 and the adjacent interlocking piece 27 are securely coupled to each other, the selected golf tee 28, the first tee hole 12, and the second tee hole 13 are designed to facilitate a tight connection that prevents the rotation of either the arbitrary interlocking piece 25 or the adjacent interlocking piece 27 about the selected golf tee 28. As can be seen in FIG. 12 through 17, a transversal cross section 30 of the tee spike 23, a transversal cross section 30 of the first tee hole 12, and a transversal cross section 30 of the second tee hole 13 may be a polygonal shape. For example, the tee spike 23, the first tee hole 12, and the second tee hole 13 may have a square-shaped transversal cross section 30 that prevents the rotation of either the arbitrary interlocking piece 25 or the adjacent interlocking piece 27 about the selected golf tee 28 when the selected golf tee 28 is inserted through either the first tee hole 12 or the second tee hole 13. Further, the transversal cross section 30 area of the tee spike 23, the first tee hole 12, and the second tee hole 13 may be equal to enable a tight fit of the tee spike 23 with the first tee hole 12 or the second tee hole 13. Thus, a secure, tight connection is made between the arbitrary interlocking piece 25 and the adjacent interlocking piece 27 using the selected golf tee 28. In other embodiments, different transversal cross section 30 shapes, or different means to lock the coupling of the arbitrary interlocking piece 25 to the adjacent interlocking piece 27 can be utilized.

As previously discussed, the at least one magnet 17 enables the removable attachment of the arbitrary interlocking piece 25 to the adjacent interlocking piece 27 instead of using the selected golf tee 28. As can be seen in FIG. 8 through 11, the at least one magnet 17 may comprise a magnet body 18 and a magnet flange 19. The magnet body 18 corresponds to the main structure of the at least one magnet 17, while the magnet flange 19 corresponds to the portion of the at least one magnet 17 that secures the magnet body 18 to the at least one magnet hole 14. Further, the at least one magnet hole 14 may comprise a body section 15 and a flange section 16. The body section 15 corresponds to the section of the at least one magnet hole 14 that accommodates the magnet body 18, while the flange section 16 corresponds to the section of the at least one magnet hole 14 that accommodates the flange section 16. Accordingly, the magnet flange 19 is terminally positioned on the magnet body 18 to help secure the at least one magnet 17 to the at least one magnet hole 14 during operation of the present invention. Further, the flange section 16 is positioned offset from the body base 6 so that the flange section 16 is positioned deep inside the triangular body 2. Thus, when the at least one magnet 17 is inserted into the at least one magnet hole 14, the magnet flange 19 is positioned within the flange section 16 and the magnet body 18 is positioned within the body section 15. This way, the at least one magnet 17 is securely held within the at least one magnet hole 14 and there is no risk of the at least one magnet 17 coming loose during operation. In other embodiments, the at least one magnet 17 may be several magnets mounted within several magnet holes distributed about the triangular body 2.

Although the invention has been explained in relation to its preferred embodiment, it is to be understood that many other possible modifications and variations can be made without departing from the spirit and scope of the invention.

What is claimed is:

1. A golf tee nest comprising:

a plurality of interlocking pieces;

a plurality of golf tees;

each of the plurality of interlocking pieces comprising a triangular body, a first tee hole, a second tee hole, at least one magnet hole, and at least one magnet;

the triangular body comprising a first body face, a second body face, a third body face, a body base, a body recession, and a base recession;

the body recession traversing into the triangular body, opposite to the body base;

the first tee hole being positioned adjacent to the second body face;

the first tee hole traversing from the first body face, through the body recession, and through the triangular body;

the second tee hole being positioned adjacent to the first body face;

the second tee hole traversing from the second body face, through the body recession, and through the triangular body;

the base recession traversing into the triangular body from the body base;

the at least one magnet hole traversing from the body base into the triangular body, opposite to the third body face;

the at least one magnet being mounted within the at least one magnet hole;

an arbitrary tee hole of an arbitrary interlocking piece being aligned with a corresponding tee hole of an adjacent interlocking piece from the plurality of interlocking pieces; and a selected golf tee from the plurality of golf tees traversing through the arbitrary tee hole of the arbitrary interlocking piece and into the corresponding tee hole of the adjacent interlocking piece.

2. The golf tee nest as claimed in claim 1 comprising:

the triangular body further comprising a first circular cutout, a second circular cutout, and a third circular cutout;

the first circular cutout being positioned equidistant from the second body face and the third body face;

the first circular cutout traversing from the first body face through the triangular body, adjacent to the body base;

the second circular cutout being positioned equidistant from the first body face and the third body face;

the second circular cutout traversing from the second body face through the triangular body, adjacent to the body base;

the third circular cutout being positioned equidistant from the first body face and the second body face; and the third circular cutout traversing from the third body face through the triangular body, adjacent to the body base.

3. The golf tee nest as claimed in claim 2, wherein a radius of the first circular cutout, a radius of the second circular cutout, and a radius of the third circular cutout are equal to each other.

4. The golf tee nest as claimed in claim 1 comprising:

the first tee hole being positioned parallel to the second body face and the third body face; and the first tee hole being positioned equidistant from the second body face and the third body face.

5. The golf tee nest as claimed in claim 1 comprising:

the second tee hole being positioned parallel to the first body face and the third body face; and the second tee hole being positioned equidistant from the first body face and the third body face.

6. The golf tee nest as claimed in claim 1 comprising:

each of the plurality of golf tees comprising a ball-receiving recession, a tee head, and a tee spike;

the tee head being terminally mounted to the tee spike;

the ball-receiving recession traversing into the tee head, opposite to the tee spike;

the tee spike of the selected golf tee traversing through the arbitrary tee hole of the arbitrary interlocking piece and into the corresponding tee hole of the adjacent interlocking piece; and the tee head of the selected golf tee being positioned within the body recession of the arbitrary interlocking piece.

7. The golf tee nest as claimed in claim 6 comprising:

a transversal cross section of the tee spike being a polygonal shape;

a transversal cross section of the first tee hole being a polygonal shape; and a transversal cross section of the second tee hole being a polygonal shape.

8. The golf tee nest as claimed in claim 1 comprising:

the at least one magnet comprising a magnet body and a magnet flange;

the at least one magnet hole comprising a body section and a flange section;

the magnet flange being terminally positioned to the magnet body;

the flange section being positioned offset from the body base;

the magnet flange being positioned within the flange section; and the magnet body being positioned within the body section.

9. A golf tee nest comprising:

a plurality of interlocking pieces;

a plurality of golf tees;

each of the plurality of interlocking pieces comprising a triangular body, a first tee hole, a second tee hole, at least one magnet hole, and at least one magnet;

the triangular body comprising a first body face, a second body face, a third body face, a body base, a body recession, and a base recession;

the at least one magnet comprising a magnet body and a magnet flange;

the at least one magnet hole comprising a body section and a flange section;

the body recession traversing into the triangular body, opposite to the body base;

the first tee hole being positioned adjacent to the second body face;

the first tee hole traversing from the first body face, through the body recession, and through the triangular body;

the second tee hole being positioned adjacent to the first body face;

the second tee hole traversing from the second body face, through the body recession, and through the triangular body;

the base recession traversing into the triangular body from the body base;

the at least one magnet hole traversing from the body base into the triangular body, opposite to the third body face;

the magnet flange being terminally positioned to the magnet body;

the flange section being positioned offset from the body base;

the magnet flange being positioned within the flange section;

the magnet body being positioned within the body section;

an arbitrary tee hole of an arbitrary interlocking piece being aligned with a corresponding tee hole of an adjacent interlocking piece from the plurality of interlocking pieces; and a selected golf tee from the plurality of golf tees traversing through the arbitrary tee hole of the arbitrary interlocking piece and into the corresponding tee hole of the adjacent interlocking piece.

10. The golf tee nest as claimed in claim 9 comprising:

the triangular body further comprising a first circular cutout, a second circular cutout, and a third circular cutout;

the first circular cutout being positioned equidistant from the second body face and the third body face;

the first circular cutout traversing from the first body face through the triangular body, adjacent to the body base;

the second circular cutout being positioned equidistant from the first body face and the third body face;

the second circular cutout traversing from the second body face through the triangular body, adjacent to the body base;

the third circular cutout being positioned equidistant from the first body face and the second body face; and the third circular cutout traversing from the third body face through the triangular body, adjacent to the body base.

11. The golf tee nest as claimed in claim 10, wherein a radius of the first circular cutout, a radius of the second circular cutout, and a radius of the third circular cutout are equal to each other.

12. The golf tee nest as claimed in claim 9 comprising:

the first tee hole being positioned parallel to the second body face and the third body face; and the first tee hole being positioned equidistant from the second body face and the third body face.

13. The golf tee nest as claimed in claim 9 comprising:

the second tee hole being positioned parallel to the first body face and the third body face; and the second tee hole being positioned equidistant from the first body face and the third body face.

14. The golf tee nest as claimed in claim 9 comprising:

each of the plurality of golf tees comprising a ball-receiving recession, a tee head, and a tee spike;

the tee head being terminally mounted to the tee spike;

the ball-receiving recession traversing into the tee head, opposite to the tee spike;

the tee spike of the selected golf tee traversing through the arbitrary tee hole of the arbitrary interlocking piece and into the corresponding tee hole of the adjacent interlocking piece; and the tee head of the selected golf tee being positioned within the body recession of the arbitrary interlocking piece.

15. The golf tee nest as claimed in claim 9 comprising:

a transversal cross section of the tee spike being a polygonal shape;

a transversal cross section of the first tee hole being a polygonal shape; and a transversal cross section of the second tee hole being a polygonal shape.

16. A golf tee nest comprising:

a plurality of interlocking pieces;

a plurality of golf tees;

each of the plurality of interlocking pieces comprising a triangular body, a first tee hole, a second tee hole, at least one magnet hole, and at least one magnet;

the triangular body comprising a first body face, a second body face, a third body face, a body base, a body recession, and a base recession;

the at least one magnet comprising a magnet body and a magnet flange;

the at least one magnet hole comprising a body section and a flange section;

the body recession traversing into the triangular body, opposite to the body base;

the first tee hole being positioned adjacent to the second body face;

the first tee hole traversing from the first body face, through the body recession, and through the triangular body;

the second tee hole being positioned adjacent to the first body face;

the second tee hole traversing from the second body face, through the body recession, and through the triangular body;

the base recession traversing into the triangular body from the body base;

the at least one magnet hole traversing from the body base into the triangular body, opposite to the third body face;

the magnet flange being terminally positioned to the magnet body;

the flange section being positioned offset from the body base;

the magnet flange being positioned within the flange section;

the magnet body being positioned within the body section;

an arbitrary tee hole of an arbitrary interlocking piece being aligned with a corresponding tee hole of an adjacent interlocking piece from the plurality of interlocking pieces; and a selected golf tee from the plurality of golf tees traversing through the arbitrary tee hole of the arbitrary interlocking piece and into the corresponding tee hole of the adjacent interlocking piece.

17. The golf tee nest as claimed in claim 16 comprising:

the triangular body further comprising a first circular cutout, a second circular cutout, and a third circular cutout;

the first circular cutout being positioned equidistant from the second body face and the third body face;

the first circular cutout traversing from the first body face through the triangular body, adjacent to the body base;

the second circular cutout being positioned equidistant from the first body face and the third body face;

the second circular cutout traversing from the second body face through the triangular body, adjacent to the body base;

the third circular cutout being positioned equidistant from the first body face and the second body face;

the third circular cutout traversing from the third body face through the triangular body, adjacent to the body base; and a radius of the first circular cutout, a radius of the second circular cutout, and a radius of the third circular cutout being equal to each other.

18. The golf tee nest as claimed in claim 16 comprising:

the first tee hole being positioned parallel to the second body face and the third body face; and the first tee hole being positioned equidistant from the second body face and the third body face.

19. The golf tee nest as claimed in claim 16 comprising:

the second tee hole being positioned parallel to the first body face and the third body face; and the second tee hole being positioned equidistant from the first body face and the third body face.

20. The golf tee nest as claimed in claim 16 comprising:

each of the plurality of golf tees comprising a ball-receiving recession, a tee head, and a tee spike;

a transversal cross section of the tee spike being a polygonal shape;

a transversal cross section of the first tee hole being a polygonal shape;

a transversal cross section of the second tee hole being a polygonal shape;

the tee head being terminally mounted to the tee spike;

the ball-receiving recession traversing into the tee head, opposite to the tee spike;

the tee spike of the selected golf tee traversing through the arbitrary tee hole of the arbitrary interlocking piece and into the corresponding tee hole of the adjacent interlocking piece; and the tee head of the selected golf tee being positioned within the body recession of the arbitrary interlocking piece.

* * * * *